US006644169B2

(12) United States Patent
Deininger et al.

(10) Patent No.: US 6,644,169 B2
(45) Date of Patent: Nov. 11, 2003

(54) CONTROL VALVE SYSTEM FOR THE HYDRAULIC WORK SYSTEM OF A WORK VEHICLE

(75) Inventors: Horst Deininger, Horstein-Alzenau (DE); Eckehart Schulze, Weissach (DE)

(73) Assignee: Linde Aktiengesellschaft (DE)

( * ) Notice: Subject to any disclaimer, the term of this patent is extended or adjusted under 35 U.S.C. 154(b) by 227 days.

(21) Appl. No.: 09/794,966

(22) Filed: Feb. 27, 2001

(65) Prior Publication Data

US 2001/0006019 A1 Jul. 5, 2001

Related U.S. Application Data

(63) Continuation of application No. 09/229,423, filed on Jan. 13, 1999, now abandoned.

(30) Foreign Application Priority Data

Feb. 4, 1998 (DE) ..... 198 04 398

(51) Int. Cl.[7] ..... F15B 11/08
(52) U.S. Cl. ..... 91/445; 137/596.17; 251/367
(58) Field of Search ..... 91/445, 446; 137/596.17; 251/367

(56) References Cited

U.S. PATENT DOCUMENTS

| | | | | | |
|---|---|---|---|---|---|
| 3,826,282 | A | * | 7/1974 | Noe | 137/625.69 |
| 3,952,996 | A | * | 4/1976 | Hart | 137/625.69 |
| 3,960,166 | A | * | 6/1976 | Linser | 137/625.69 |
| 3,976,103 | A | * | 8/1976 | Ostic | 137/625.69 |
| 4,020,867 | A | * | 5/1977 | Sumiyoshi | 137/596.13 |
| 4,111,283 | A | * | 9/1978 | Hastings, Jr. | 91/445 |
| 4,182,126 | A | * | 1/1980 | Blakeslee | 60/459 |
| 4,235,156 | A | * | 11/1980 | Olsen | 91/467 |
| 4,341,149 | A | * | 7/1982 | Dezelan | 91/445 |
| 4,418,612 | A | * | 12/1983 | Nanda | 91/445 |
| 4,569,272 | A | * | 2/1986 | Taylor et al. | 91/445 |
| 4,745,844 | A | * | 5/1988 | Larsen | 91/451 |
| 4,835,966 | A | * | 6/1989 | Kauss et al. | 91/445 |
| 4,838,306 | A | * | 6/1989 | Horn et al. | 137/522 |
| 4,936,032 | A | * | 6/1990 | Marcon et al. | 137/601.13 |
| 4,960,035 | A | * | 10/1990 | Kauss | 91/445 |
| 5,040,367 | A | * | 8/1991 | Kauss | 60/452 |
| 5,046,310 | A | * | 9/1991 | Kauss | 60/468 |
| 5,067,389 | A | * | 11/1991 | St. Germain | 91/446 |
| 5,095,697 | A | * | 3/1992 | Kauss | 60/452 |
| 5,115,720 | A | * | 5/1992 | Babson et al. | 91/448 |
| 5,243,820 | A | * | 9/1993 | Shimoura et al. | 60/452 |
| 5,259,192 | A | * | 11/1993 | Karakama et al. | 60/422 |
| 5,562,019 | A | * | 10/1996 | Kropp | 91/516 |

* cited by examiner

*Primary Examiner*—Edward K. Look
*Assistant Examiner*—Michael Leslie
(74) *Attorney, Agent, or Firm*—Webb Ziesenheim Logsdon Orkin & Hanson, P.C.

(57) ABSTRACT

A valve system is provided for the hydraulic work system of a work vehicle, in particular of an industrial truck, with a elevating drive system for raising and lowering a load and a tilting drive system, each of which can be actuated by a control valve, in particular by an electrically actuated control valve, the opening width of which determines the speed of movement of the user. The elevating drive system is realized in the form of a single-action hydraulic cylinder and a check valve in the form of a seat valve that can be opened toward the hydraulic cylinder is located in a hydraulic line leading from the control valve to the hydraulic cylinder. The tilting drive system is realized in the form of a double-action hydraulic cylinder. The valve system has an improved function with low energy losses.

20 Claims, 8 Drawing Sheets

CONTROL VALVE SYSTEM FOR THE HYDRAULIC WORK SYSTEM OF A WORK VEHICLE

CROSS-REFERENCE TO RELATED APPLICATIONS

This application is a continuation of U.S. patent application Ser. No. 09/229,423, filed Jan. 13, 1999, entitled "Control Valve System for the Hydraulic Work System of a Work Vehicle," now abandoned.

BACKGROUND OF THE INVENTION

1. Field of the Invention

This invention relates generally to a valve system for the hydraulic work system of a work vehicle, in particular an industrial truck, with an elevating drive system to raise and lower a load and a tilting drive system, each of which can be actuated by respective control valves, in particular by electrically actuated control valves, the opening width of which determines the speed of movement of the respective users, wherein the elevating drive system is realized in the form of a single-action hydraulic cylinder and a check valve that is realized in the form of a seat valve and opens toward the hydraulic cylinder and is located in a hydraulic line that leads from the control valve to the hydraulic cylinder, and wherein the tilting drive system is realized in the form of a double-action hydraulic cylinder.

2. Description of the Currently Available Technology

Valve systems of the type described above are used in industrial trucks, for example, and in fork lift trucks in particular. The elevating drive system, in the form of one or more lifting cylinders connected in series, is used to raise and lower loads. To raise the load, the lifting cylinder, which is realized in the form of a single-action hydraulic cylinder, can be connected by means of a control valve to a pump line, and for lowering the load it can be connected to a return line that is connected to a reservoir. In such a case, the control valve is realized in the form of a proportional valve, the opening width of which determines the quantity of hydraulic fluid that is admitted into the lifting cylinder or is discharged from the lifting cylinder, and thus determines its speed of movement. A pilot-controlled check valve in the hydraulic line that leads from the control valve to the lifting cylinder blocks off the lifting cylinder with no leakage of hydraulic fluid. In systems of the prior art, during the lifting operation, the check valve is switched into the open position by the pressure of the hydraulic fluid flowing into the lifting cylinder. For lowering, the check valve is unblocked, whereby the check valve is opened by the pressure in the pump line. In that case, however, to open the check valve to lower the load, a pressure must first be built up in the pump line that at least equals the load pressure of the elevating drive system to switch the check valve into the open position. That results in energy losses which, on battery-operated fork lift trucks in particular, lead to a reduced operating time of a charged battery.

When electrically actuated control valves are used, such as control valves actuated by electromagnets, for example, it must also be taken into consideration that the control valve for the elevating drive system cannot be opened too wide when a load is being lowered to prevent an excessively rapid descending movement and to guarantee that there is a sufficient braking distance available for the deceleration of the load. For this purpose, on electrically actuated control valves of the prior art, the opening width of the control valve is limited in the "descent" position, which means that small loads are lowered at a slow speed of descent since, as the result of the presence of only a small pressure differential at the throttle point of the control valve, the speed of descent that can be used to lower a large load cannot be achieved.

The hydraulic cylinders of the tilting drive system are generally realized in the form of double-action hydraulic cylinders. To achieve a firm restraint of the hydraulic cylinders in tilting drive systems of the prior art, there is a pilot-controlled check valve in each of the hydraulic lines that leads to the hydraulic cylinders. The check valve located in the discharge line is thereby switched into the open position by the pressure in the respective admission line. However, such a system is susceptible to oscillations. To prevent oscillations, high restraining pressures of the check valves are set that must accordingly be overcome by the admission pressure to achieve a high stability. However, especially when the loads to be moved by the tilting drive system are small, there are large losses that lead to a shorter battery life in industrial trucks that are powered by rechargeable batteries.

Therefore, it is an object of the invention to make available a valve system of the type described above that has an improved function with low energy losses.

SUMMARY OF THE INVENTION

The invention provides a valve system in which the check valve has a control surface that acts toward the opening position, which control surface can be pressurized by the load pressure of the elevating drive system, and a control pressure chamber of the check valve that acts toward the closed position, which control pressure chamber can be pressurized with the load pressure of the elevating drive system and, when the control valve is actuated into the "descent" position, can be placed in communication with a reservoir, and/or that there are flow regulators located in both the admission line and in the discharge line respectively of the control valve of the tilting drive system, which flow regulators have an open and a closed position, whereby the flow regulators are respectively pressurized toward the closed position by the pressure upstream of the throttle point of the control valve, and toward the open position by the pressure downstream of the throttle point of the control valve and by a spring.

The control pressure chamber of the check valve that is pressurized by the load pressure of the elevating drive system and is active in the closed position can thus be relieved when a load is lowered. The check valve is thereby opened by the load pressure of the elevating drive system that is applied to the control surface that acts in the opening direction. When the user is idle, the hydraulic line that leads to the lifting cylinder is blocked off by the check valve without any leakage of hydraulic fluid. When the load is lowered, the control pressure chamber of the check valve pressurized by the load pressure is thereby relieved and the check valve is actuated by the load pressure applied to the control surface that acts in the opening direction. No pressure needs to be built up in the pump line to open the check valve, and consequently there are no energy losses.

The hydraulic cylinders of the tilting drive system are restrained by means of respective flow controllers in the admission and discharge lines of the tilting drive system, whereby the admission-side flow controller is controlled by the pressure decrease at the admission-side throttle point, and the discharge-side flow controller is controlled by the pressure decrease at the discharge-side throttle point of the control valve. The flow controllers thereby maintain the incoming and outgoing flow of hydraulic fluid, regardless of the load, at the value specified by the opening width of the control valve. The tilting drive system can thereby be operated at the speed of movement specified at the control valve, independent of the height of the load. The tilting drive system is thereby restrained in both directions of movement between the flow regulators, whereby the only loss is the pressure drop that is necessary for the control of the flow regulators at the throttle points of the control valve.

The switching systems of the invention for the elevating drive system and the tilting drive system can be used individually or in combination with one another. Their combined use increases the efficiency of the overall system.

It is particularly advantageous if the control pressure chamber of the check valve can be placed in communication with a relief valve that is realized in the form of a seat valve and can be connected to a reservoir, whereby the relief valve can be moved into a closed position by the load pressure of the elevating drive system, and into an open position when the control valve of the elevating drive system is actuated into the "descent" position, in which position the control pressure chamber of the check valve can be placed in communication with a reservoir. When the user is at idle, the hydraulic line leading to the lifting cylinder is therefore blocked off without any leakage of hydraulic fluid by the check valve and the relief valve which is realized in the form of a seat valve. During the descent, the control pressure chamber of the check valve, which is pressurized by the load pressure, can easily be placed in communication with the reservoir by means of the relief valve acting as a pilot valve, and the check valve can be actuated.

In one embodiment of the invention, the control pressure chamber of the check valve can be pressurized by means of a fixed diaphragm with the load pressure of the elevating drive system. When the elevating drive system is not actuated, therefore, the load pressure of the elevating drive system is applied to the control surface and in the control pressure chamber, as a result of which the check valve is held in the closed position. When the control pressure chamber of the check valve is depressurized by opening the relief valve, a pressure drop occurs at the diaphragm, as a result of which the pressure in the control pressure chamber of the check valve is lower than the load pressure of the elevating drive system being applied to the control surface. It thereby becomes possible to ensure in a simple manner that the check valve is deflected into the open position at the beginning of the descent movement.

The invention teaches that it is particularly advantageous if a stepper motor is provided as the actuator device of the control valve of the elevating drive system, whereby the stepper motor is effectively connected to the relief valve, and when the control valve is actuated into the "descent" position, the stepper motor moves the relief valve into the open position. The stepper motor is actuated by means of a digital actuation signal, for example a number of control pulses, and converts the actuator signals into a position of the output shaft and thus a corresponding position of the control valve. As a result of the digital actuation, a precise gradation of the position of the output shaft of the stepper motor and a high accuracy of repetition can be achieved, as a result of which the control valve for the elevating drive can also be actuated with a high degree of precision and repeatability. As a result of the actuation of the relief valve into the open position by the stepper motor, when the control valve is actuated into a position to lower a load, the relief valve can be easily opened and thus the check valve can be actuated.

It is thereby particularly advantageous if the control valve of the elevating drive system is realized in the form of a longitudinal slide valve with a slide piston, and the stepper motor is connected to the valve slide of the control valve by means of a transmission, in particular a spindle-nut transmission, whereby the valve slide is secured to prevent rotation and is mounted so that it can move longitudinally in a housing boring, and whereby a spring device is provided that holds the valve slide in the middle position when the slide is not actuated. As a result of the presence of a spindle-nut transmission, it is easy to convert a rotational movement of the output shaft of the stepper motor into a translation motion for the deflection of the valve slide of the control valve. The spring device ensures that when the stepper motor is not actuated, the control valve is maintained in the middle position, and thus the elevating drive system is blocked off, with no leakage of hydraulic fluid, by the check valve and the relief valve.

The invention teaches that it is particularly advantageous if the relief valve has a valve body that is effectively connected by means of an actuator element to the valve slide of the control valve of the elevating drive system. The actuator element can be, for example, a pin located on the valve body of the relief valve, which pin is effectively connected with the valve slide. When the stepper motor is actuated and thus there is a deflection of the valve slide into the descent position, it thereby becomes possible to easily move the relief valve into the open position.

In one embodiment of the invention, in the return line that runs from the control valve to the tank line, there is a descent braking valve that can be pressurized toward an open position by a spring and by the pressure downstream of the control valve, and toward a closed position by the pressure upstream of the control valve. During the descent, a defined speed of descent is specified by the opening width of the control valve. The descent braking valve thereby controls the speed of descent regardless of the load being exerted on the elevating drive system. For this purpose, the descent braking valve is controlled by the pressure decrease that occurs at the discharge-side throttle point of the control valve. For a small load, there is a small decrease in pressure at the control valve, as a result of which the descent braking valve is held in the open position. For a large load, and thus a high load pressure upstream of the control valve, there is a large decrease in pressure at the control valve, as a result of which the descent braking valve is pressurized toward the closed position, thereby preventing an increase in the speed of descent.

It is particularly advantageous if the opening orifices exposed by the control valve of the tilting drive system in the admission line and the discharge line are realized so that they correspond to the ratio of the surface area of the piston rod and the surface area of the piston of the hydraulic cylinder of the tilting drive system. It thereby becomes possible in a simple manner to specify different hydraulic flows for the piston side and the piston rod side of the double-action hydraulic cylinder.

In one advantageous embodiment of the invention, in the delivery line downstream of the control valve of the elevating drive system and upstream of the control valve of the tilting drive system, there is a check valve that opens toward the control valve of the tilting drive system. When the elevating drive system is actuated to raise a load, with a simultaneous actuation of the tilting drive system, operating conditions can sometimes occur in which hydraulic fluid flows from the tilting drive system to the elevating drive system, if the elevating drive system is supporting a lower load than the tilting drive system. The result can be a direction of movement that is opposite to the desired direction of movement of the tilting drive system. During such operating conditions, the check valve in the delivery line of the pump prevents hydraulic fluid from flowing back to the elevating drive system, and thus has the function of a load maintenance valve for the tilting drive system.

In one embodiment of the invention, there is at least one additional drive system, in particular for the drive system of a side loader, which drive system is realized in the form of a double-action hydraulic cylinder and can be actuated by means of a control valve, in particular by means of an electrically actuated control valve that is connected downstream of the control valve of the tilting drive system to the pump line, whereby a load pressure signal line is connected downstream of the admission-side throttle cross section of the control valves, and the load pressure signal lines are connected by means of a system of shuttle valves to a common load pressure signal line which is connected to a pressure balance. The load pressure signal line of the elevating drive system can thereby be connected to the control pressure line that leads to the control surface of the descent braking valve that is active in the closed position, which control pressure line is connected between the control valve and the check valve to the hydraulic line that leads to the lifting cylinder. On the tilting drive system, the load pressure signal line can be connected to the control pressure line that leads to the control surface, i.e. the one that is active in the open position, of the flow regulator that is located in the admission line.

The pressure balance appropriately connects the delivery line with the tank line and has a closed position and an open position, whereby the pressure balance is pressurized toward the open position by the pump pressure and toward the closed position by the highest load pressure of the actuated users applied to the common load pressure signal line, as well as by a spring. The pressure balance thus ensures that only the hydraulic flow required by the users flows to the users, and the additional amount of hydraulic fluid delivered, e.g. by a constant velocity pump, can flow back to the reservoir. When the users are not actuated, the pressure balance ensures the unpressurized circulation of the hydraulic fluid delivered by the pump.

In one preferred embodiment, the actuator device of the control valve of the tilting drive system and the actuator device of the control valve of the additional drive system are realized in the form of a double-action proportional magnet, whereby the control valves are centered in their middle position by means of a spring device. Such double-action proportional magnets take up significantly less space than two separate proportional magnets for the deflection in both directions of a control valve of a double-action user.

In one particularly advantageous embodiment of the invention, the control valve of the elevating drive system and/or the control valve of the tilting drive system and/or the control valve of the additional user and/or the check valves and/or the pressure relief valve and/or the flow regulators and/or the shuttle valves and/or the pressure balance are located in a control block that has a multi-layered construction consisting of a plurality of segmental plates that are connected to one another in a laminated fashion and have recesses, the contours and location of which in relation to one another form hydraulic fluid channels and housing borings, as well as control chambers. The recesses in the segmental plates can be manufactured by a laser cutting process, for example, or by stamping. Such a control block consisting of a plurality of segmental plates, in which the individual segmental plates are soldered to one another, for example, is significantly faster, easier and cheaper to manufacture than a conventional control block manufactured using casting technology. In addition, the channels, borings and control chambers for the control valves can be created in a simple manner by the recesses in the segmental plates in the control block. For this purpose, only the valve seats of the seat valves and the housing borings that hold the control slides of the longitudinal slide valves in the control block need to be machined. On longitudinal slide valves, the machining activities can be limited to a single fabrication step, e.g. to a honing process. In addition, the control block takes up significantly less space than conventionally manufactured control blocks, because there is no need to leave room for the minimum orifices required for casting the channels and borings. As a result, there is also a significant reduction in the weight of the control block.

The invention teaches that it is particularly advantageous to locate the connections for the pump line and the tank line as well as the connections for the hydraulic lines leading to the users on one surface of a segmental plate that forms a lateral surface of the control block, and to locate the electrical actuator devices of the control valves on the opposite lateral surface of the control block that is formed by a surface of an additional segmental plate. The user connections as well as the actuator devices are thus formed on opposites sides of the control block, each of which is formed by a surface of a segmental plate. Consequently, the control block takes up a particularly small amount of space, because it is no longer necessary to machine the edges of the segmental plates and likewise it is no longer necessary to machine the edges of the lateral surfaces of the laminated control block that is formed by the edges of the segmental plates.

In one embodiment of the control block, the connections for a pump connection and a tank connection as well as the connection sockets for the user connections are soldered into the control block. The connection sockets, which have threaded sections to receive lines or hoses, can be realized in the form of prefabricated parts that can easily be soldered into corresponding borings of the segmental plates.

It is also particularly appropriate if the actuator devices of the control valves are fastened in housing components that are soldered into the control block. The housing components, which have corresponding threaded connections for the fastening of the electrical actuator devices, can therefore also be manufactured separately, and can be easily soldered into borings in the segmental plates.

It is also particularly advantageous if the housing borings of the control valves and/or the housing boring of the pressure balance and/or the housing boring of the pressure relief valve and/or the housing borings of the check valves and/or the housing borings of the flow regulators and/or the housing boring of the descent braking valve and/or the housing boring of the shuttle valves, all of which are located in the control block, can be closed by means of housing components that are soldered into the control block. The housing borings, which also form control pressure chambers for the corresponding valves, can thus be closed in a simple manner.

The result is that the control block can be manufactured more easily and more economically, because no covers or plugs are necessary for the control pressure chambers or to close the housing borings, which covers or plugs would have to be fastened to the control block by means of corresponding threaded connections.

BRIEF DESCRIPTION OF THE DRAWINGS

Additional advantages and features of the invention are explained in greater detail below with reference to the exemplary embodiments illustrated in the accompanying schematic figures, in which.

DESCRIPTION OF THE PREFERRED EMBODIMENTS

Figure 1:
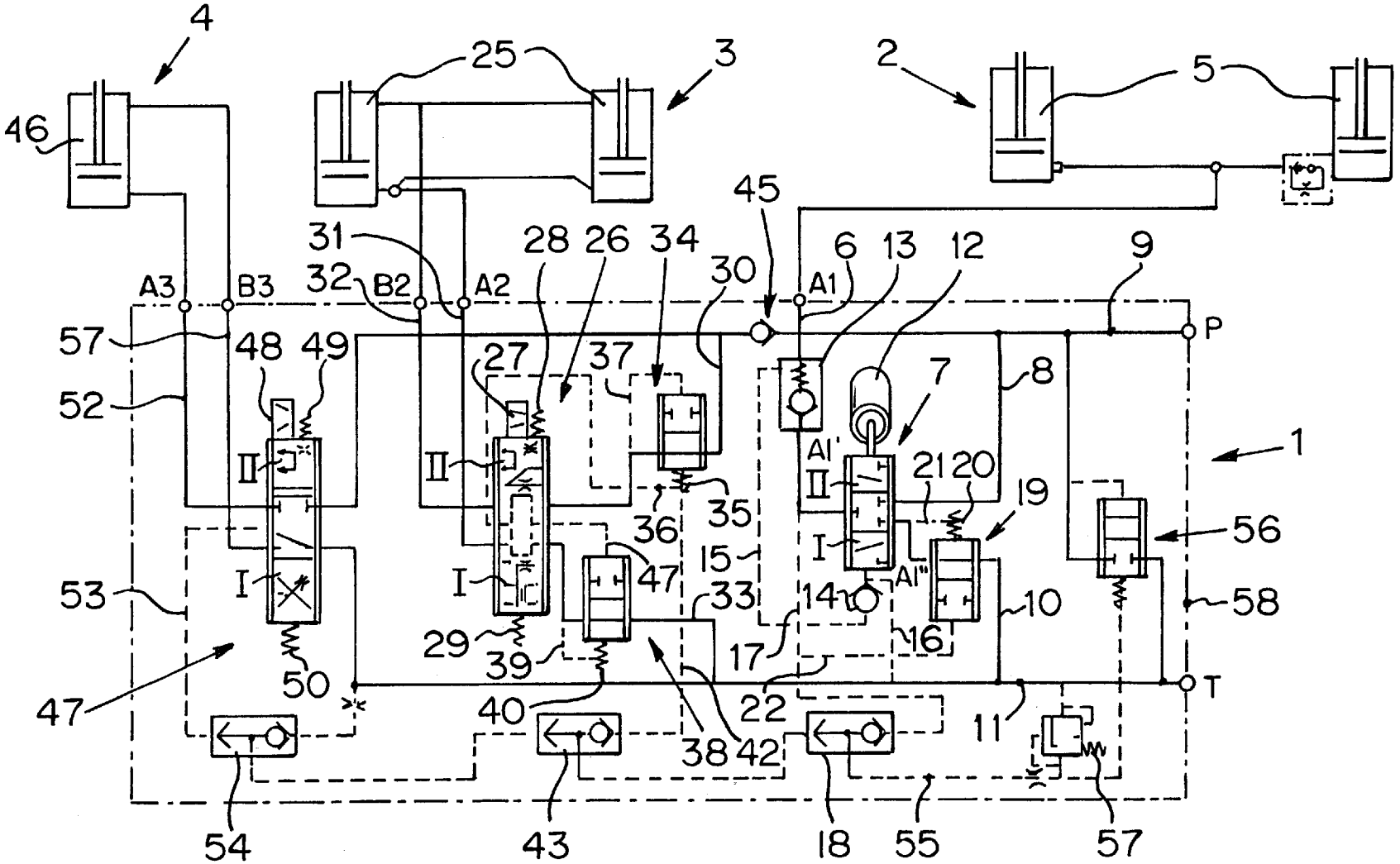
FIG. 1 is a hydraulic circuit diagram of a valve system of the invention.

For purposes of the description hereinafter, the terms "left", "right", "above", "below" and similar terms relate to the invention as it is oriented in the drawings. However, it is to be understood that the invention may assume various alternative orientations, except where expressly specified to the contrary. It is also to be understood that the specific devices and processes illustrated in the drawings and described in the specification are simply exemplary embodiments of the invention and hence are not to be considered as limiting to the scope of the invention.

FIG. 1 shows the hydraulic circuit diagram 1 of the valve system claimed by the invention for the hydraulic work system of an industrial truck such as a fork lift truck, for example, with an elevating drive system 2, a tilting drive system 3 and an additional drive system 4, e.g. to drive a side loader.

The elevating drive system 2 includes two lifting cylinders 5 that are realized in the form of single-action hydraulic cylinders 5, and are connected by means of a hydraulic line 6 to the output of a control valve 7. The elevating drive system control valve 7 is connected on the input side to an admission line 8 which branches off from a delivery line 9 that is connected to a pump (not shown), and to a return line 10 which leads to a tank line 11 that is connected to a reservoir. The control valve 7 is realized in the form of a proportional valve and has a middle position in which the connection of the hydraulic line 6 to the inlet line 8 and to the return line 10 is closed. In a first switching position I for lifting a load located on load-holding means, the admission line 8 is connected to the hydraulic line 6 and the return line 10 is blocked. In a second switching position II for lowering a load, the admission line 8 is blocked and the hydraulic line 6 is connected to the return line 10.

The control valve 7 can be actuated electrically, whereby the control slide of the control valve 7 is driven by a stepper motor 12. In the hydraulic line 6, there is a check valve 13 that opens toward the hydraulic cylinders 5, and when the elevating drive system is not actuated blocks the hydraulic line 6 to prevent the leakage of any hydraulic fluid. The check valve 13 is pressurized in the closing direction by the load pressure of the elevating drive system 2 and by a spring, and can be opened by a pressure relief valve 14 that is realized in the form of a seat valve. For this purpose, a control line 15 runs from the spring side of the check valve 13 to the relief valve 14, which can be connected on its back side by means of a line 16 to the tank line 11. The actuation of the relief valve 14 in the opening direction is effected by the stepper motor 12, whereby for this purpose the valve body of the pressure relief valve 14 is actuated by the control slide of the control valve 7 such that when there is a deflection of the control slide toward the second switching position II to lower a load, the pressure relief valve 14 is opened and thus the spring side of the check valve 13 is depressurized by means of the control line 15 and the line 16 to the tank.

Connected in the hydraulic line 6 between the control valve 7 and the check valve 13 there is a load pressure signal line 17 that runs to the input of a shuttle valve 18.

In the return line 10, there is a descent braking valve 19 that acts as a throttle in intermediate positions, and can be actuated toward an open position by a spring 20 and the pressure in the return line 10 upstream of the descent braking valve 19, and toward a closed position by the load pressure of the lifting cylinder 5 available in the load pressure signal line 17. For this purpose, there is a control pressure line 21 that runs from the return line 10 downstream of the control valve 7 to a control surface of the control valve 7 that acts toward the open position. A control pressure line 22 is connected to a control surface of the descent braking valve 19 that acts toward the closed direction as well as to the load pressure signal line 17. The descent braking valve 19 controlled by the load pressure of the elevating drive system 2 therefore maintains the speed of descent, regardless of the weight of the load, at a value specified by the opening width of the control valve 7.

The tilting drive system 3 has two tilting cylinders that are realized in the form of double-action hydraulic cylinders 25 that can be actuated by means of a control valve 26. The tilting drive system control valve 26 is realized in the form of a proportional valve and can be actuated electrically. For this purpose, there is a double-action proportional magnet 27 that has two magnet systems, by means of which the control valve 26 can be deflected from a middle position in which it is centered between two springs 28, 29, and in which the connections of the control valve 26 are closed, into respective switched positions, for example for tilting the lifting mast forward or backward. In the first switching position I, an admission line 30 that branches off from the delivery line 9 is connected to a hydraulic line 31 that is in communication with the connection A2. A hydraulic line 32 that is connected to the connection B2 is in communication with a return line 33 that runs to the tank line 11. In the second switching position II, the admission line 30 correspondingly is connected to the hydraulic line 32 and the hydraulic line 31 to the discharge line 33. In the admission line 30, there is an inlet-side flow regulator 34, which is controlled by the pressure differential that occurs at the inlet-side throttle point of the control valve. The flow regulator 34 is thereby actuated toward an open position by the pressure downstream of the inlet-side throttle point and by a spring 35, and toward a closed position by the pressure upstream of the inlet-side throttle point of the control valve 26. For this purpose, a control pressure line 36 that is connected to a connection of the control valve 26, at which the pressure downstream of the inlet-side throttle point is applied in switching positions I and II, runs to a control surface of the flow regulator 34 that is active toward the open position. A control surface of the flow regulator 34 that is active in the closed position is in communication with a control pressure line 37, which is connected to the supply line 30 upstream of the control valve 26 and therefore upstream of the inlet-side throttle point. In the discharge line 33 there is a discharge-side flow regulator 38 which is controlled by the pressure differential at the discharge-side throttle point of the control valve 26. For this purpose, a control pressure line 39 runs to a control surface of the flow regulator 38 that acts in the opening direction, and the control pressure line 39 is connected to the discharge line 33 downstream of the control valve 26. The force of a spring 40 also applies pressure in the opening direction. The control pressure line 39 is therefore pressurized in the switching position I and II of the control valve 26 by the pressure downstream of the discharge-side throttle point. The flow regulator 38 can be actuated toward the closed position by the pressure upstream of the discharge-side throttle point of the control valve 26, whereby a control pressure line 41 runs to a connection of the control valve 26, which is pressurized in the switched position I and II with the pressure upstream of the discharge-side throttle point. The flow regulators 34 and 38 therefore maintain the incoming and outgoing flow of hydraulic fluid regardless of the load on the value specified by the opening width of the control valve 26, and thus maintain the position of the tilting drive system 3. The different hydraulic flows for the piston side and the piston rod side of the hydraulic cylinders 25 can easily be specified by the magnitude of the opening widths of the admission and discharge orifices in the control valve 26.

Branching off from the control pressure line 36 is a load pressure signal line 42, which runs to the input of a shuttle valve 43, which is in communication on the output side with the second input of the shuttle valve 18.

Downstream of the branched connection of the admission line 8 that leads to the elevating drive system 2 and upstream of the branched connection of the inlet line 30 that leads to the tilting drive system 3, a check valve 45 that opens toward the inclination drive system 3 and the additional drive system 4 is located in the delivery line 9. In operating conditions in which the tilting drive system 3 and/or the additional drive system 4 are actuated, and simultaneously the control valve 7 of the elevating drive system 2 is actuated into the switching position to lift a load, the check valve 45 prevents hydraulic fluid from flowing out of the tilting drive system or the additional drive system and into the lifting cylinder 5, and thus the tilting drive system or the additional drive system cannot execute an uncontrolled movement if the elevating drive system is pressurized by a small load.

The additional drive system 4 also has a double-action hydraulic cylinder 46 which can be actuated by a control valve 47 realized in the form of a proportional valve, and which is connected to the delivery line 9 and to the tank line 11. The control valve 47 can be actuated by means of a double-action proportional magnet 48. In a middle position centered by springs 49, 50, the connection of the delivery line 9 and of the tank line 11 to the hydraulic lines 51, 52 connected to the hydraulic cylinder 46 is closed. In a first switched position I, the delivery line 9 is connected to the hydraulic line 51 and the hydraulic line 52 is connected to the return tank line 11. In the second switched position II, a connection is created between the delivery line 9 and the hydraulic line 52, as well as a connection between the hydraulic line 51 and the return tank line 11. In addition, connected to the control valve 47 is a load pressure signal line 53 which, in the switched positions I and II, can be pressurized with the load pressure of the user downstream of the inlet-side throttle point of the control valve 47. The load pressure signal line 53 is connected to the input of an additional shuttle valve 54, which is connected on the output side with the additional input of the shuttle valve 43.

The shuttle valves 18, 43 and 54 thus form a system of shuttle valves, so that when more than one user is actuated simultaneously, the highest load pressure present at the users 6, 25, 46 is present in a common load pressure signal line 55 that is connected to the output of the shuttle valve 18. The load pressure signal line 55 extends to a control surface of a pressure balance 56 that acts in the closing direction, and the pressure balance 56 is connected on the input side with the delivery line 9 and on the output side with the tank line 11. In the opening direction, the pressure balance 56 is pressurized by the delivery pressure of the pump present in the delivery line 11. In the load pressure signal line 55, there is also a pressure limiting valve 57 that is provided to limit the maximum allowable pump pressure.

The control valves 7, 26 and 47 described above, as well as the check valves 13, 45, the pressure relief valve 14, the descent braking valve 19, the flow regulators 34, 38, the shuttle valves 18, 43, 54 and the pressure balance 56 as well as the pressure limiting valve 57 are located in a control block 58, which has a pump connection P that connects the delivery line 9 with the pump, and a tank connection T that connects the tank line 11 with a reservoir. By means of a user connection A1, the hydraulic line 6 can be connected to the lifting cylinder 5. The hydraulic cylinder 25 of the tilting drive system 3 and the hydraulic cylinder 41 of the additional drive system 4 can be connected to the hydraulic lines 31, 32 and 51, 52 by means of user connections A2, B2, and A3, B3 respectively.

Figure 2:
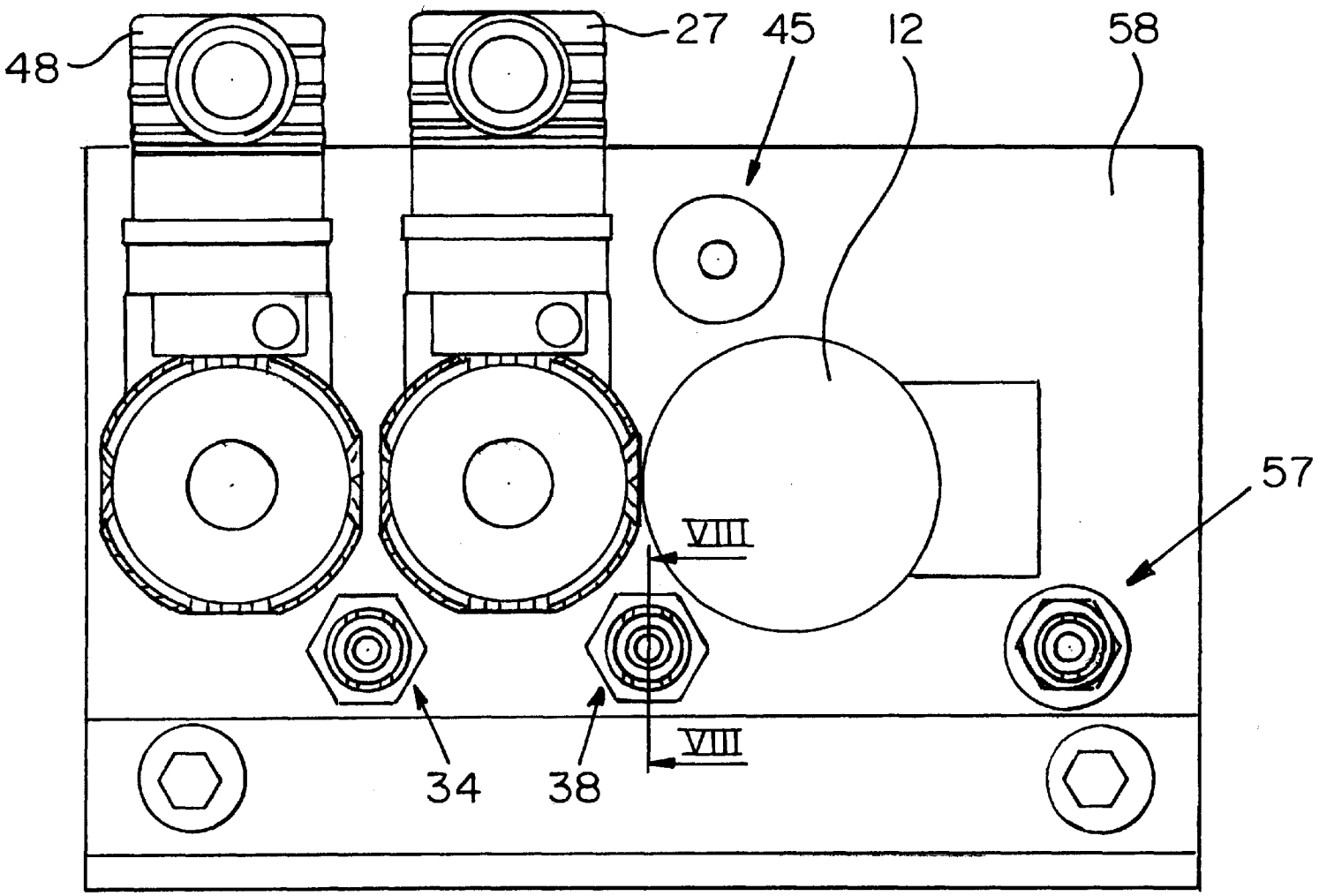
FIG. 2 is a view of the lateral surface of a control block of the invention.

FIG. 2 shows a side surface of the control block 58. Located on this side surface, in addition to the stepper motor 12 that actuates the control valve 7, are the double-action proportional magnets 27 and 48 for the actuation of the control valves 26 and 47. Also located on this side surface are the pressure limiting valve 57, the flow regulators 34 and 38 and the check valve 45.

Figure 3:
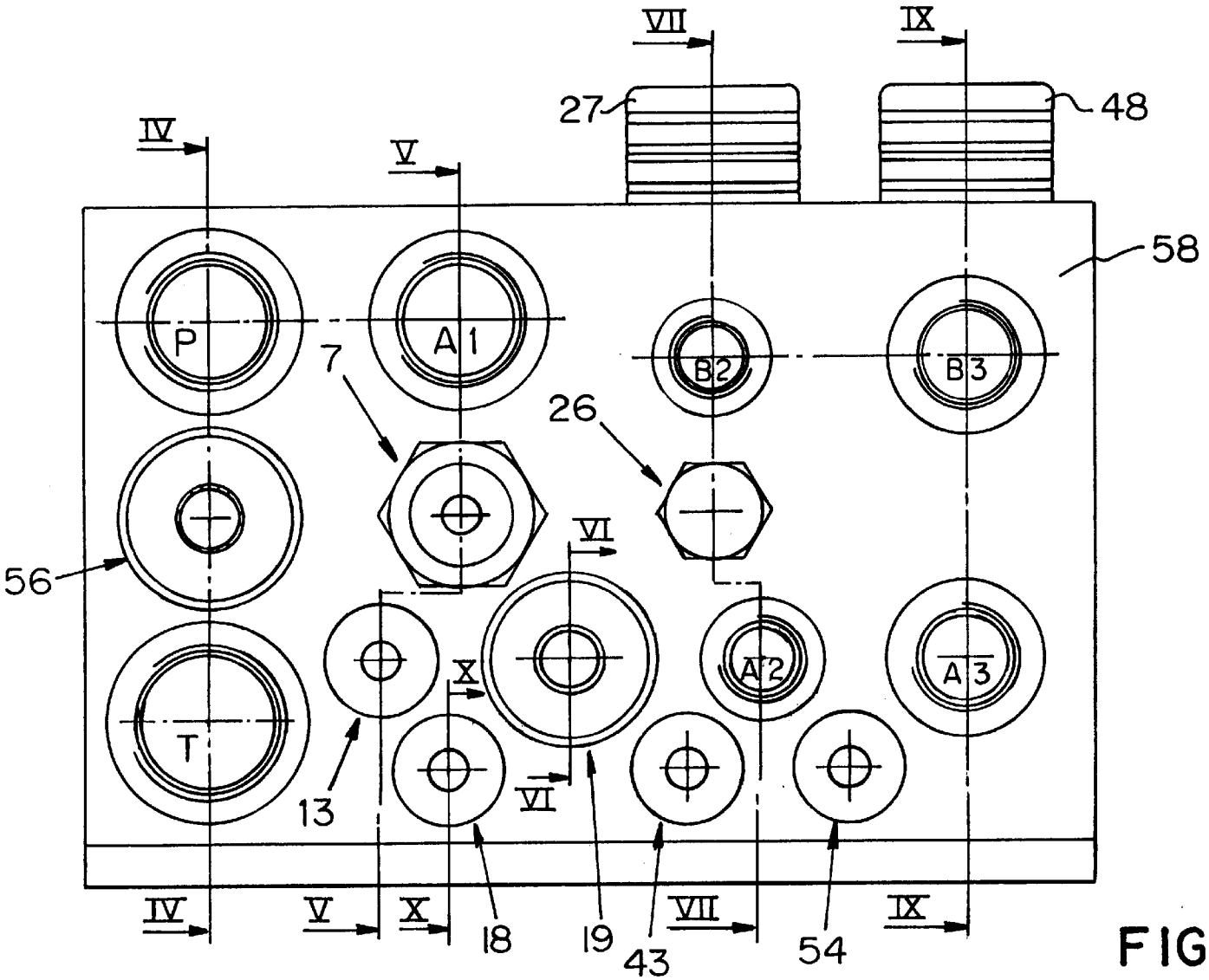
FIG. 3 is a view of the lateral surface of the control block opposite the lateral surface illustrated in FIG. 2.

FIG. 3 shows a side surface of the control block 58 that is on the side opposite the side surface illustrated in FIG. 2. On this side surface are the connection P and the connection T, as well as the connection A1 of the elevating drive system, the connections A2, B2 of the tilting drive system and the connections A3, B3 of the additional drive system. This figure also illustrates the location of the pressure balance 56 and of the control valves 7 and 26 in the control block 58. FIG. 3 also shows the location of the check valve 13, of the descent braking valve 19 and of the shuttle valves 18, 43 and 54.

FIGS. 4 to 10 illustrate the construction of the control block 58 and of the valves located in the control block 58.

Figure 4:
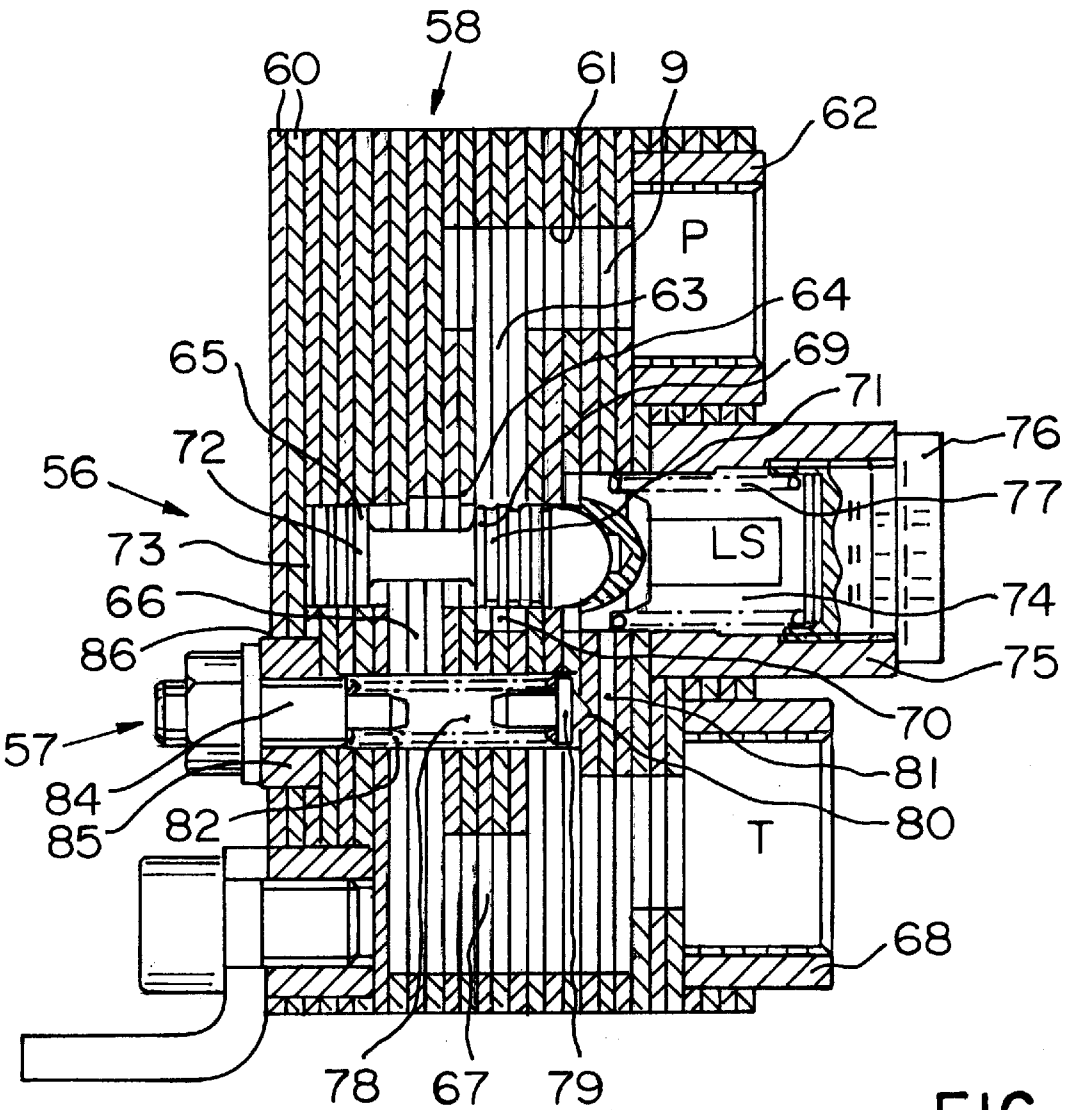
FIG. 4 is a sectional view taken along Line IV—IV in FIG. 3.

FIG. 4 shows that the control block 58 has a laminated construction consisting of a plurality of segmental plates 60 located next to one another, which can be soldered to one another, for example. The segmental plates 60 have recesses and borings that, depending on their coaxial arrangement and their contours, form hydraulic channels and housing borings and valve seats for the valves. The recesses in the respective segmental plates 60 can be stamped, for example, or can be manufactured by a laser cutting process.

Some of the segmental plates are provided with recesses that are aligned with one another and form a channel 61. The channel 61 is realized in a large-diameter area in an area facing the right side surface in the figure, in which a connection socket 62 for the pump connection P has been soldered. The connection socket 62 is provided with a thread for the connection of the hydraulic line that is connected to the pump. The channel 61 thereby forms the delivery line 9. The channel 61 emerges into a channel 63 that runs at substantially right angles to the channel 61, and is in communication with a housing boring 64 that is formed from concentrically located recesses in the segmental plates 60. A control slide 65 of the pressure balance 56 is located in a sealed manner so that it can move longitudinally in the housing boring 64. Connected to the housing boring 64 at some axial distance from the channel 63 is an additional channel 66 that is formed by recesses in a plurality of segmental plates and emerges into a hydraulic channel 67 which is formed by a plurality of borings in the segmental plates 60, which borings are in communication with one another, and the connection socket 68 for the tank connection T is soldered in the external portion of the segmental plates 60.

The channel 63 thereby forms an annular groove 70 that encircles the housing boring 64. In the vicinity of the hydraulic channel 63, the control slide 65 has a flange 69 which forms a control edge together with the housing boring 64 and the annular groove 70. In the vicinity of the flange 69, located in the control slide 65, is a transverse boring 71 that is in communication with the channel 63 and emerges into a longitudinal boring 72 located in the control slide 65, and is in communication with the end surface 73 of the control slide 65 located in the housing boring 64. The end surface 73 forms a control surface that actuates the control slide 65 toward an open position. The opposite end surface of the slide piston 65, together with borings of the segmental plates 60, forms a control pressure chamber 74 that acts in the closing direction of the pressure balance 56 and is connected to the common load pressure signal line in a manner not illustrated in any further detail. The control pressure chamber 74 is closed by a housing component 75 that is soldered into the segmental plates 60. Also provided in the housing component 75 is an adjusting screw 76 for a spring 77.

An additional housing boring 78 that is formed by borings in the segmental plates and is oriented parallel to the housing boring 64 is used to hold the pressure limiting valve 57. The housing boring 78 is thereby in communication with the hydraulic channel 67 connected to the tank line 11. The valve body 79 of the pressure limiting valve 57 actuates a valve seat which is formed by a boring 80 in a segmental plate, which boring 80 is oriented coaxially to the housing boring 78, whereby the boring 80 is in communication with the control pressure chamber 74 by means of a channel 81 formed in a neighboring segmental plate. The valve body 70 can be actuated in the closing direction by a spring 82 which is located in the housing boring 78 and the bias of which can be adjusted by means of a threaded spindle 84 and a nut 85 that is soldered into a boring 86 formed by recesses in the segmental plates 60, which recesses are oriented concentric to the housing boring 78.

Figure 5:
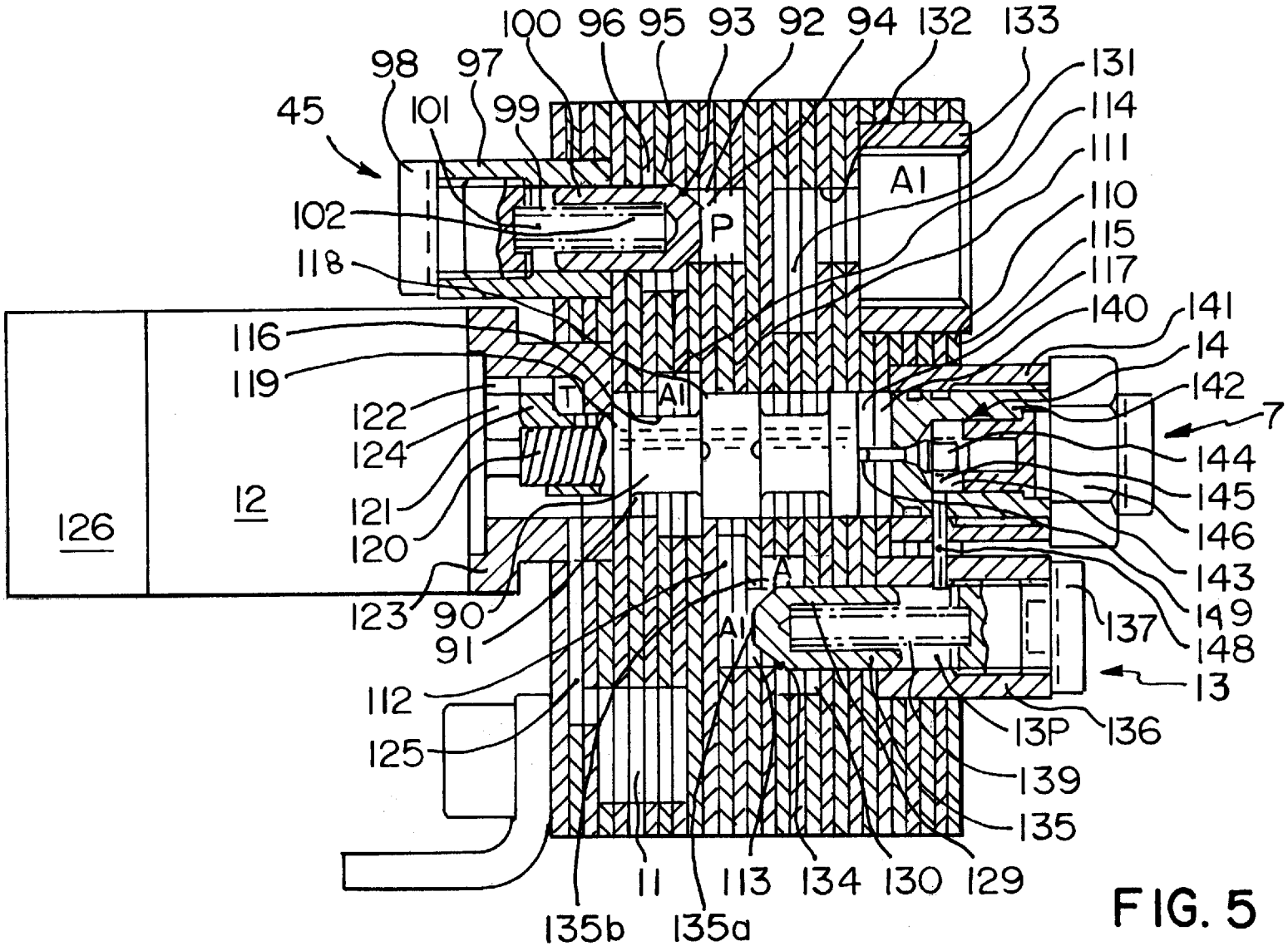
FIG. 5 is a sectional view taken along Line V—V in FIG. 3.

FIG. 5 illustrates the construction of the control valve 7 for the elevating drive system 2, the control slide 90 of which is mounted so that it can move longitudinally in a housing boring 91 formed from concentric recesses in the segmental plates 60.

The check valve 45 is located in a housing boring 92 that is oriented parallel to the housing boring 91. The housing boring 92 thereby consists of a plurality of borings located in the segmental plates that form a pump channel 94 which—as illustrated in FIGS. 5 and 4—is in communication with the boring 61 connected to the P-connection and is therefore in communication with the delivery line 9. An annular groove 95 that is formed by recesses in a plurality of segmental plates 60 and radially surrounds the housing boring 92, is in communication with a pump channel 96 and leads to the control valves of the tilting drive system 3 and of the additional drive system 4. At the transition between the channel 94 and the annular groove 95 there is a valve seat 93 formed for the check valve 45. Also soldered into the housing boring 92 is a housing component 97 into which a screw plug 98 is screwed. The screw plug 98 is in communication with a spring 99, which applies pressure to the valve body 100 of the check valve 45 toward the valve seat 93 and thus the closed position. The housing component 97 and the screw plug 98 also form a control pressure chamber 101 that acts in the closing direction of the check valve 45 and is pressurized by the pressure in the pump channel 96 and thus by the pressure downstream of the check valve 45. For this purpose, located in the vicinity of the annular groove 95 is a transverse boring 102 in the valve body 100 which is in communication by means of a diaphragm with the control pressure chamber 101.

In the housing boring 91 of the control valve 7 there is an annular groove 110 which is in communication with the pump channel 94 in a manner not illustrated in any further detail. An additional annular groove 111 formed in the housing boring 91 is in communication with a channel 112 formed in a plurality of segmental plates, which channel 112 emerges into a housing boring 113 that is also oriented parallel to the housing boring 91 and is formed by a plurality of circular recesses in the segmental plates. The housing boring 113 holds the check valve 13. An additional annular groove 114 formed in the housing boring 91 is in communication with the tank line 11 in a manner not illustrated in any further detail and is formed by recesses in a plurality of segmental plates. The tank line 11 is thereby in communication with the channel 67 as illustrated in FIG. 4.

The control slide 90 of the control valve 7 has grooves 115 and 116 as well as piston flanges 117, 118, 119, whereby in the event of a deflection of the control slide 90 to the left in the figure, a communication is created between the annular groove 110 and the annular groove 111 by means of the groove 115, and in the event of a deflection toward the right in the figure, a connection is created between the annular groove 111 and the annular groove 114 by means of the groove 116. For the actuation of the control slide 90, there is a spindle-nut transmission that consists of a threaded spindle 120 that is connected to the output shaft of the stepper motor 12 and is engaged with the nut 121 which is in turn non-rotationally connected with the valve body 90. To prevent the rotation of the valve body 90, the nut 120 is connected to a groove 112 which is formed in a housing component 123 which is soldered into the outer area of the housing boring 91 and is also provided for the fastening of the stepper motor 12. The compartment 124 that holds the spindle-nut transmission is in communication with the tank line 11 by means of a transverse boring in the housing 123 and a channel 125 formed by a recesses in a segmental plate. Also provided on the stepper motor 12 is a spring device 126 which, when the stepper motor 12 is not actuated, moves the control slide 90 into the illustrated middle position.

The housing boring 113 that is in communication with the channel 112 has an annular groove 130 that is in communication with a channel 131 that is connected to a housing boring 132, in which is soldered a connection socket 133 for the user connection A1. At the transition from the housing boring 113 to the annular groove 130 there is a valve seat 134 that is actuated by the valve body 135 of the check valve 13. On the end surface, the valve body 135 has a first control surface 135*a* which can be pressurized with the pressure in the hydraulic channel 112, and a second control surface 135*b* at which the pressure in the annular groove 130 and thus the load pressure of the elevating drive system is present. The control surface 135*b* that acts in the opening direction is thereby formed by an ring-shaped area on the end surface of the valve body 135, which ring-shaped area extends from the valve seat 134 to the outside diameter of the valve body 135. Soldered into the housing boring 113 is a housing component 136 that is closed with a screw plug 137. The valve body 135, the closing element 136 and the screw plug 137 form a control pressure chamber 138 in which there is a spring 139 which pushes the valve body 135 toward the valve seat 134 and thus toward the closed position. The valve body 135 is also pressurized toward the closed position by the load pressure of the elevating drive system that is present in the control pressure chamber 138. For this purpose, there is a transverse boring 129 with a diaphragm in the valve body 135 in the vicinity of the annular groove 130.

The control pressure chamber 138 can also be placed in communication with a tank chamber 140 that is in communication with the tank line 11, which tank chamber 140 is formed by the housing boring 91 and the control slide 90 and a housing component 141 that is soldered into the housing boring 90. The pressure relief valve 14 is also located in the housing component 141. For this purpose, a valve seat element 142 is screwed into the housing component 141 for the pressure relief valve 14, whereby the valve seat element 142 forms a control pressure chamber 143 to hold the valve body 144 of the pressure relief valve 14. The control pressure valve 143 is thereby in communication with the tank chamber 140 by means of an axial boring 145, whereby the valve seat for the pressure relief valve 14 is formed at the transition from the control pressure chamber 143 into the axial boring 145. The control pressure chamber 143 is also closed by means of a screw plug 146 that is screwed into the valve seat element 142. Also located in the control pressure chamber 143 is a spring that pushes the valve body 142 into the closed position. To connect the control pressure chamber 138 of the check valve 13 with the control pressure chamber 143 of the pressure relief valve, there is a channel 148 that consists of a boring in the closing element 136 and in the closing element 141 as well as the valve seat element 142, which are connected to one another by means of a recess formed in a segmental plate. The valve body 144 of the pressure relief valve 14 is in communication with an actuator element 149 that is realized in the form of a pin 149 that extends through the axial boring 145, which pin is in communication with the end surface of the control piston 91 formed on the flange 117.

When there is a deflection of the control piston 91 of the elevating drive system to the right in the figure, to lower a load, and thus in the event of communication between the annular groove 111 by means of the groove 116 with the annular groove 114, the valve body 144 is simultaneously moved to the right in the figure by means of the pin 149, and thus the pressure relief valve 14 is opened. The control pressure chamber 138 of the check valve 13 that is pressurized by the load pressure of the elevating drive system present in the transverse boring 129 is thus connected to the tank chamber 140 by means of the channel 148 and the control pressure chamber 143 and the axial boring 145 exposed by the valve element 144, as a result of which the valve body 135 of the check valve 13 is moved into the open position by the load pressure of the elevating drive system applied to the second control surface 135*b*, against the force of the spring 139. Hydraulic fluid can thus flow from the connection A1 via the channel 131 into the annular groove 130, the opened check valve 13 into the channel 112, and thus into the annular groove 111, and from there via the groove 116 into the annular groove 114 that is in communication with the tank line 11. The control edge exposed by the groove 116 of the control slide 90 between the annular groove 111 and the annular groove 114 thereby determines the speed of descent of the elevating drive system.

Figure 6:
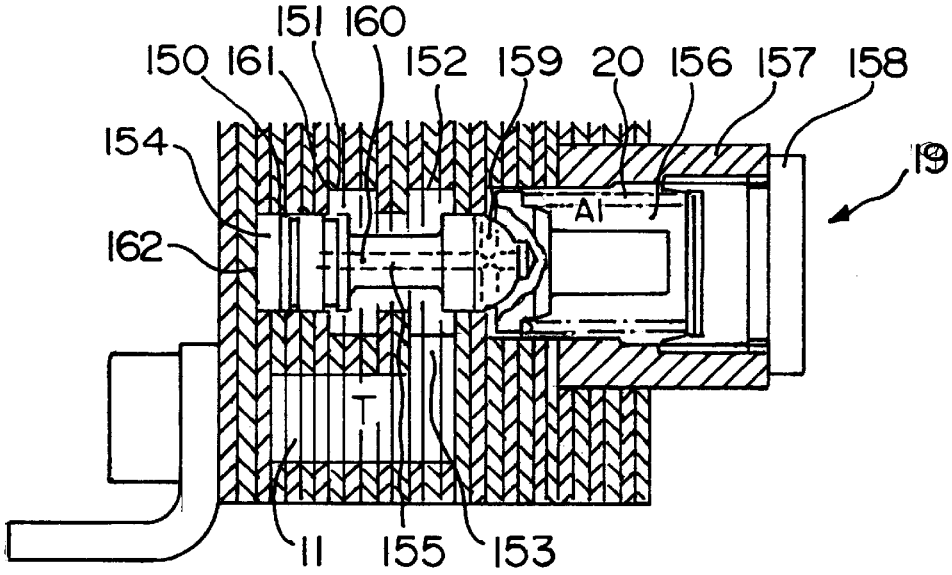
FIG. 6 is a sectional view taken along Line VI—VI in FIG. 3.

FIG. 6 shows the location of the descent braking valve 19, which is mounted so that it can move longitudinally in a housing boring 150 formed by coaxial borings in a plurality of segmental plates. An annular groove 151 located in the housing boring 150—as can be seen by observing FIGS. 6 and 5 together—is in communication with the annular groove 114. An additional annular groove 152 of the housing boring 150 is connected to the tank line 11 by means of a channel 153 formed by recesses in the segmental plates. The valve body 154 of the descent braking valve 19 has a groove 155 which, in the illustrated position of the valve body 154, opens the connection between the annular grooves 151 and 152. The valve body 154 can be pushed toward this position by the force of the spring 20 which is located in a control pressure chamber 156 which is formed by the housing boring 150 and a housing component 157 soldered in it, as well as a screw plug 158 located in a housing component 157. The control pressure chamber 156 can thereby be pressurized with the pressure in the annular groove 151 and thus with the pressure downstream of the control valve 7, whereby for example a transverse boring 159 in the valve body 154 that is in communication with the annular groove 151 is formed which emerges into a longitudinal boring 160 to which is connected a transverse boring 161 that is in communication with the annular groove 151. The end surface 162 of the valve body 154 that faces the control pressure chamber 156 can be pressurized in a manner not illustrated in any further detail with the pressure in the annular groove 111 or the channel 91, and thus during the descent by the pressure upstream of the control valve 7 toward a throttle position.

Figure 7:
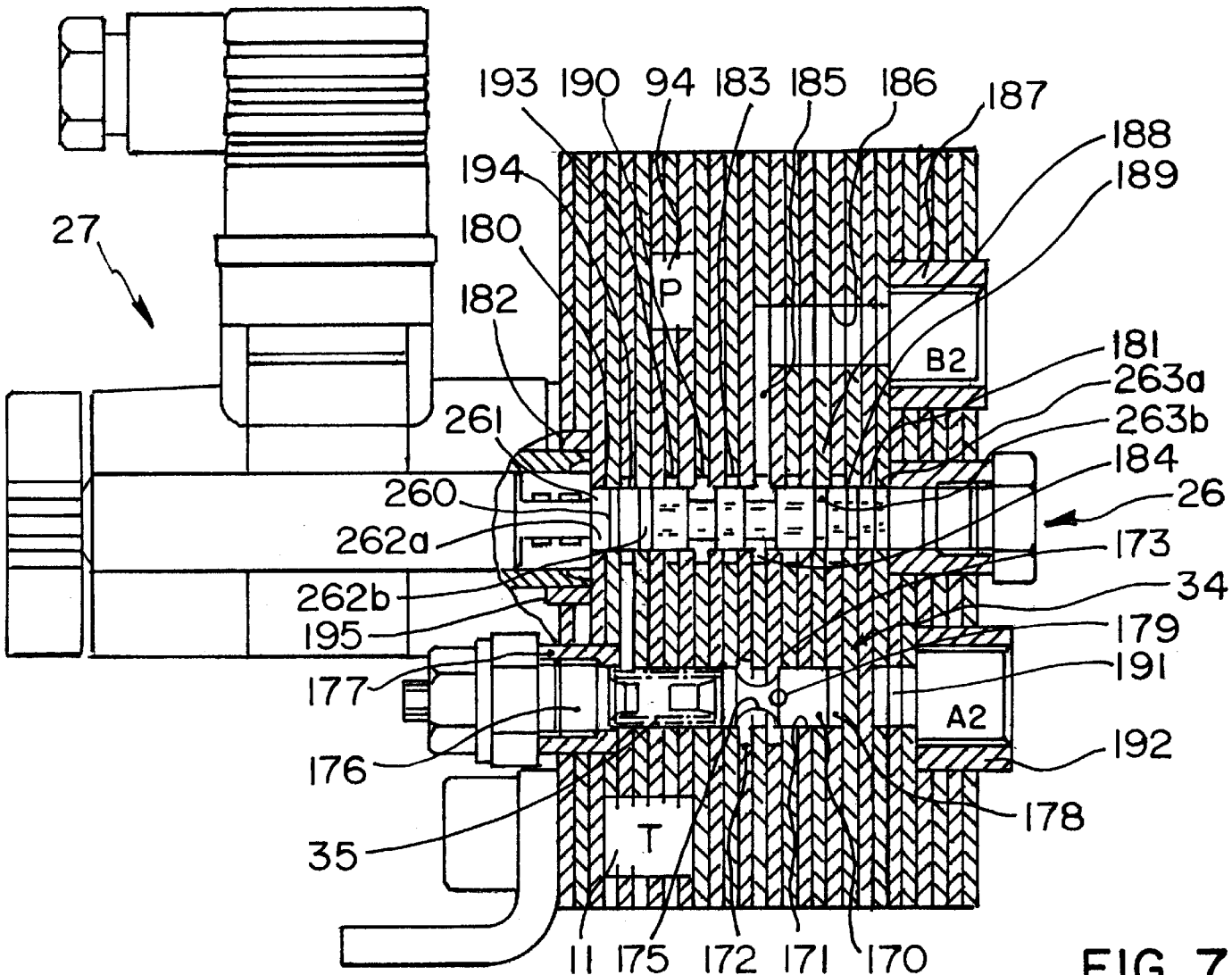
FIG. 7 is a sectional view taken along Line VII—VII in FIG. 3.

FIG. 7 illustrates the location of the control valve and the location of the admission-side flow regulator 34 of the inclination drive system 3. The valve body 170 of the flow regulator 34 is mounted so that it can move longitudinally in a housing boring 171 which has an annular groove 172 that is in communication in a manner not illustrated in any further detail with the pump channel 94. An annular groove 173 at some axial distance from the annular groove 172 forms the admission for the control valve 26. The valve body 170 of the flow regulator 34 has a groove 175 which, in the illustrated position, creates a connection between the annular groove 172 and the annular groove 173. The valve body 170 can be pushed toward this switching position by a spring 35 which is located in the housing boring 171, and the bias of which spring can be adjusted by means of an adjusting screw 176 which is screwed into a housing component 177 that is soldered into the housing boring 171. The end surface of the valve body 170 opposite the spring side forms, in the housing boring 171, a control pressure chamber 178 which—as illustrated in FIG. 1—is pressurized by the pressure upstream of the control valve 26. For this purpose, in the valve body 170 there is a transverse boring 179 that is in communication with an annular groove 173, which transverse boring 179 is in communication with a longitudinal boring that leads to the end surface.

The control slide 180 of the control valve 26 is mounted so that it can move longitudinally in a housing boring 181 that is formed from a plurality of circular recesses that are aligned with one another in the segmental plates, and can be actuated by means of the double-action proportional magnet 27. The proportional magnet 27 is thereby fastened to a housing component 182 that is soldered in an outer area of the boring 181.

Located in the housing boring 181 is an annular groove 183 which is in communication in a manner not illustrated in any further detail with the annular groove 173 located on the housing boring 171. An annular groove 184 is connected to a channel 185 which emerges into a boring 186 in which a connection socket 187 of the connection B2 of the tilting drive system is soldered. An additional annular groove 188 can be connected to the tank line 11. To measure the pressure upstream of the discharge-side throttle point of the control valve 26 there is an annular groove 189. An additional annular groove 190 is connected in a manner not illustrated in any further detail to a channel 191, in which is located the connecting socket 192 of the connection A2 of the tilting drive system. An additional annular groove 193 is connected to the tank line 11. To measure the pressure downstream of the admission-side throttle point there is an additional annular groove 194 which is connected to a channel 195 which emerges into the housing boring 171, as a result of which the spring side of the inlet-side flow regulator 34 can be pressurized with the pressure downstream of the admission-side throttle point.

The control slide 180 has a groove 260 which, in the illustrated neutral position of the control valve 26, is in communication with the annular groove 184. In the neutral position, an additional groove 261 is connected to the annular groove 190. On each of the outer ends of the control slide 180 are two grooves 262*a*, 262*b* and 263*a*, 263*b* respectively which, in the event of a deflection of the control slide 180, can be connected to the annular grooves 194 and 189 respectively.

In the event of a deflection to the right in the figure, the groove 261 connects the annular groove 183 to the annular groove 190. The annular groove 184 is connected to the annular groove 188 via the groove 260. The groove 261 therefore forms the admission-side throttle point and the groove 260 the discharge-side throttle point of the control valve 26. The annular groove 194 is thereby in communication with the groove 262*a* for the measurement of the pressure downstream of the admission-side throttle point, whereby a connection is established from the annular groove 262*a* by means of transverse and longitudinal borings located in the control slide to the groove 261. The pressure upstream of the discharge-side throttle point is reported via the groove 263*b* into the annular groove 189, whereby corresponding longitudinal and transverse borings from the groove 260 to the groove 263*b* are located in the control slide 180.

In a corresponding manner, when there is a deflection to the left in the figure, the groove 261 forms the discharge-side throttle point and the groove 260 forms the admission-side throttle point. The annular groove 194 is thereby connected with the groove 262*b* and the annular groove 189 with the groove 263*a*. To measure the pressure downstream of the admission-side throttle point, the groove 260 is thereby in communication with the groove 262*b* by means of transverse and longitudinal borings in the control slide 180. Accordingly, the pressure upstream of the discharge-side throttle point is reported to the annular groove 189 by means of a connection of the groove 261 with the groove 263*a* by means of a communication formed by longitudinal and transverse borings in the control slide 180.

Figure 8:
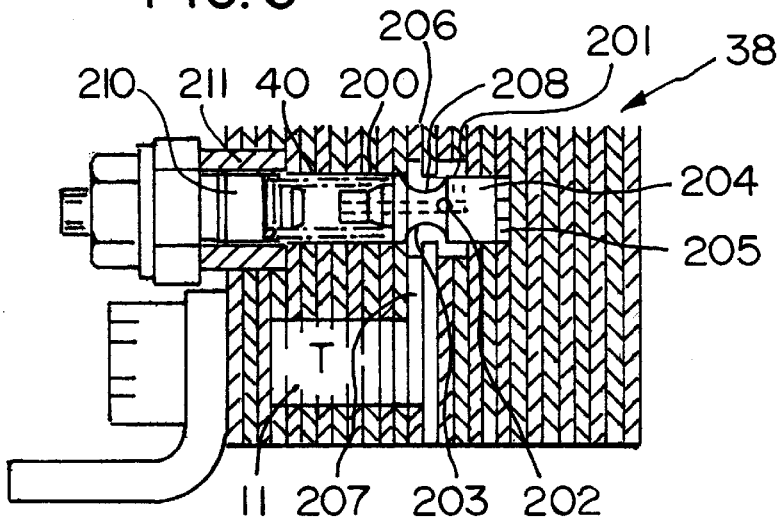
FIG. 8 is a sectional view taken along Line VIII—VIII in FIG. 2.

FIG. 8 illustrates the construction of the discharge-side flow regulator 38. In a housing boring 200 formed from borings in a plurality of segmental plates, there is an annular groove 201 which is connected to the annular grooves 188 and 193 of the control valve 26. An annular groove 206 located on the housing boring 200 and at some distance from the annular groove 201 is connected to a channel 207, which is in communication with the tank line 11. The valve body 204 has a groove 208 which, in the illustrated position, connects the annular groove 201 with the annular groove 206. The flow regulator 38 can be pressurized in the opening direction by the spring 40 which is located in the housing boring 200. At the same time, the pressure in the annular groove 201 and thus the pressure downstream of the discharge-side throttle point of the control valve 26 is present via a transverse boring 202 and a longitudinal boring 203 in the valve body 204 on the spring side of the flow regulator 38, and thus pressurizes the flow regulator 38 into the open position. The end surface of the valve body 204 opposite the spring side, together with the boring 200, forms a control pressure chamber 205 which is connected to the annular groove 189 of the control valve 26, as a result of which the flow regulator can be pressurized toward a throttle position by the pressure upstream of the discharge-side throttle point of the control valve 26. The bias of the spring 40 can be adjusted by means of an adjustment screw 210 which is screwed into a housing component 211 which is in turn soldered into the housing boring 200.

Figure 9:
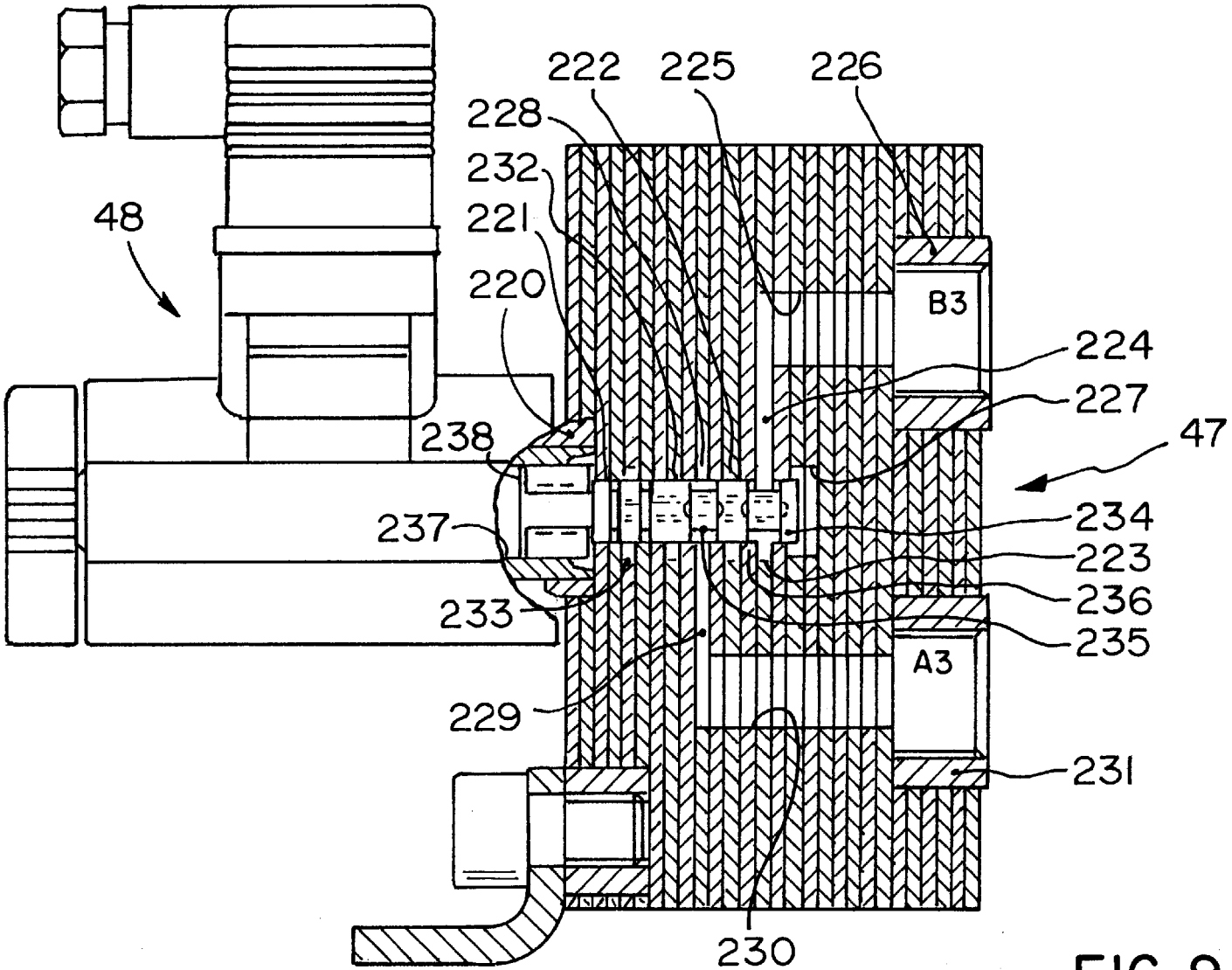
FIG. 9 is a sectional view taken along Line IX—IX in FIG. 3.

FIG. 9 shows the construction of the control valve 47, which is realized in the form of a longitudinal slide valve and is part of the additional drive system 4 that can be actuated by means of the double-action proportional magnet 48. In this case, the proportional magnet 48 is fastened to a housing component 220 which is soldered into the outer area of a housing boring 221 which is formed by a plurality of concentrically oriented circular recesses in the segmental plates 60 and holds the control slide 234 of the control valve 47. An annular groove 222 located on the housing boring 221 is in communication, in a manner not illustrated in any further detail, with the pump channel 94. An additional annular groove 223 is connected to a channel 224 that emerges into a boring 225, in which is soldered the connection socket 226 for the connection B3. An additional annular groove 227 is in communication with the tank line 11. There is also an annular groove 228 which emerges into a channel 229. The channel 229 is in communication with a boring 230, into which is soldered a connection socket 231 for the user connection A3. An annular groove 232 is connected to the tank line 11. There is an annular groove 233 for the measurement of the load pressure of the user. On the control slide 234 there are two grooves 235, 236 for the actuation of the annular grooves 222, 223 and 227, as well as the annular grooves 222, 228 and 232. Two additional annular grooves 237, 238 in the valve body 234 are each connected to the annular groove 233, as a function of the deflection of the valve body, and conduct the load pressure present downstream of the control valve 47 in the connections A3 and B3 respectively into the load pressure signal line. The annular groove 238 is thereby in communication, for example, via borings in the valve body 234 with the annular groove 235. The annular groove 237 is in communication with the annular groove 236 via corresponding transverse and longitudinal borings.

Figure 10:
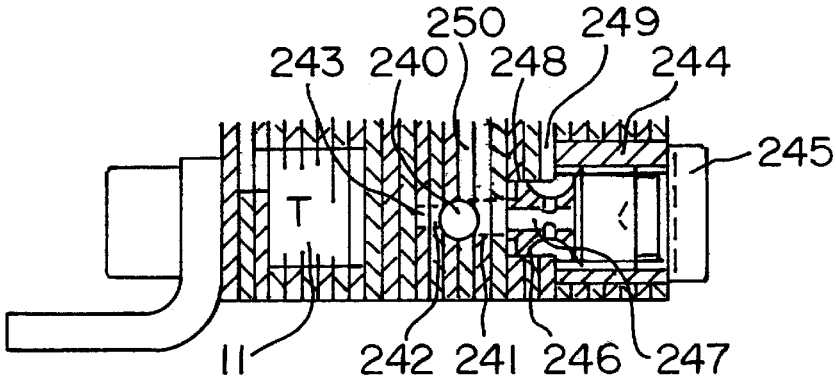
FIG. 10 is a sectional view taken along Line X—X in FIG. 3.

FIG. 10 illustrates the configuration of the shuttle valve 18, 43, 54 in the load pressure signal line. The shuttle valve has a valve element 240, for example a ball, which is located in a boring 241 and has a first valve seat which is formed at the transition of a boring 242 located coaxially to the boring 241 in a segmental plate with a smaller diameter. A channel 243 located in a segmental plate is in communication with the boring 242 and forms the first input of the shuttle valve. Soldered onto the side of the boring 241 opposite the first valve seat is a housing component 244 which by means of a screw plug 245 keeps a valve element 246 in contact with one shoulder of the boring 241. The valve element 246 thereby forms a second valve seat of the shuttle valve. In the valve element 246 there is a longitudinal boring 247 which is in communication with the boring 241, from which longitudinal boring 247 a transverse boring 248 branches off and is in communication with a channel 249 in a segmental plate, and forms a second input of the shuttle valve. The output of the shuttle valve forms a channel 250 that is made up of recesses in several segmental plates, which channel 250 is connected between the valve seats to the boring 241, and runs to the input of an additional shuttle valve or the control pressure chamber 74 of the pressure balance 56.

We claim:

1. A valve system for the hydraulic work system of a work vehicle, comprising:

an elevating drive system for raising and lowering a load, the elevating drive system including a control valve, a hydraulic cylinder and a hydraulic line extending between the control valve and the hydraulic cylinder;

a tilting drive system having a hydraulic cylinder and a control valve, with admission and discharge lines in flow communication with the tilting drive system control valve; and a check valve located in the hydraulic line extending between the elevating drive system control valve and hydraulic cylinder, the check valve including a control surface that acts in a direction of an opening position, which control surface is pressurizable by a load pressure of the elevating drive system, and a control pressure chamber that acts in the direction of a closing position, which control pressure chamber is pressurizable by the load pressure of the elevating drive system and is in flow communication with a reservoir when the elevating drive system control valve is actuated to a descent position.

2. The valve system as claimed in claim 1, including flow regulators having open and closed positions located in the tilting drive system admission and discharge lines, wherein the flow regulators are pressurized toward the closed position by a pressure upstream of a throttle point of the tilting drive system control valve and toward an open position by a pressure downstream of the throttle point of the tilting drive system control valve and a spring, and wherein the flow regulator in the admission line is controlled by a pressure decrease at an admission-side throttle point of the control valve and the flow regulator in the discharge line is controlled by a pressure decrease at a discharge-side throttle point of the control valve.

3. The valve system as claimed in claim 2, wherein an opening orifice of throttle points in the admission line and in the discharge line exposed by the control valve of the tilting drive system are dimensioned as a function of a ratio of a surface area of a piston and a surface area of a piston rod of the hydraulic cylinder of the tilting drive system.

4. The valve system as claimed in claim 2, including at least one additional drive system which includes a double-action hydraulic cylinder and which is actuated by an additional control valve, the additional control valve connected to a delivery line downstream of the control valve of the tilting drive system, wherein downstream of an admission-side throttle orifice of the control valves, respective load pressure lines are connected and the load pressure signal lines are connected by a system of shuttle valves formed from a plurality of shuttle valves to a common load pressure signal line that is connected to a pressure balance.

5. The valve system as claimed in claim 4, wherein the pressure balance connects the delivery line to the tank line and has a closed position and an open position, and wherein the pressure balance is pressurized toward the open position by pump pressure and toward the closed position by the highest load pressure of the actuated users present in the common load pressure line and by a spring.

6. The valve system as claimed in claim 4, wherein an actuator device of the control valve of the tilting drive system and of the control valve of the additional drive system is configured as a double-action proportional magnet, whereby the tilting drive system and additional drive system control valves are centered in a middle position by a spring device.

7. The valve system as claimed in claim 4, wherein at least one of the elevating drive system control valve, the tilting drive system control valve, the additional drive system control valve, the check valves, a relief valve, the flow regulators, the shuttle valves and the pressure balance are located in a control block that has a laminated construction including a plurality of segmental plates that are laminated to one another and have recesses, the contours and orientation of which in relation to one another form hydraulic channels and housing borings as well as control pressure chambers.

8. The valve system as claimed in claim 7, wherein on one surface of a segmental plate that forms one lateral surface of the control block are located a connection socket for a pump connection and a connection socket for a tank connection with connection sockets for user connections and electrical actuator devices of the control valves located on an opposite lateral surface of the control block which is formed by a surface of an additional segmental plate.

9. The valve system as claimed in claim 8, wherein the connection sockets for the pump connection and the tank connection as well as the connection sockets for the user connections are soldered into the control block.

10. The valve system as claimed in claim 7, wherein the actuator devices of the control valves are fastened in housing components that are soldered into the control block.

11. The valve system as claimed in claim 1, wherein the control pressure chamber is in flow communication with a pressure relief valve which is realized in the form of a seat valve and is in flow communication with a reservoir, wherein the relief valve is movable into a closed position by a load pressure of the elevating drive system, and into an open position when the control valve of the elevating drive system is actuated into the descent position in which the control pressure chamber of the check valve is in communication with the reservoir.

12. The valve system as claimed in claim 11, including a stepper motor generally connected to the control valve of the elevating drive system, wherein the stepper motor is effectively connected with the relief valve and moves the relief valve into the open position when the elevating drive system control valve is actuated into the descent position.

13. The valve system as claimed in claim 12, wherein the control valve of the elevating drive system is realized as a longitudinal slide valve with a valve slide, and the stepper motor is connected to a control piston of the elevating drive system control valve by a transmission, wherein the valve slide is mounted non-rotationally but so that it is movable longitudinally in a housing boring and wherein a spring device holds the valve slide in a middle position in a non-actuated status.

14. The valve system as claimed in claim 13, wherein the transmission is a spindle-nut transmission.

15. The valve system as claimed in claim 1, wherein the control pressure chamber of the check valve is pressurized by a fixed diaphragm with a load pressure of the elevating drive system.

16. The valve system as claimed in claim 1, including a return line extending from the control valve of the elevating drive system to a tank line, with a descent braking valve located in the return line and which descent braking valve is pressurized toward an open position by a spring and the pressure downstream of the throttle point of the elevating drive system control valve and toward a closed position by the pressure upstream of the throttle point of the elevating drive system control valve.

17. The valve system as claimed in claim 1, including an additional check valve located in a delivery line downstream of the control valve of the elevating drive system and upstream of the control valve of the tilting drive system, the additional check valve openable toward the control valve of the tilting drive system.

18. The valve system as claimed in claim 1, wherein the elevating drive system includes a single-action hydraulic cylinder and the tilting drive system includes a double-action hydraulic cylinder.

19. A valve system for the hydraulic work system of a work vehicle, comprising:

an elevating drive system for raising and lowering a load, the elevating drive system including a control valve, a hydraulic cylinder and a hydraulic line extending between the control valve and the hydraulic cylinder;

a tilting drive system having a hydraulic cylinder and a control valve, with admission and discharge lines in flow communication with the tilting drive system control valve;

a check valve located in the hydraulic line extending between the elevating drive system control valve and hydraulic cylinder, the check valve including a control surface that acts in a direction of an opening position, which control surface is pressurizable by a load pressure of the elevating drive system, and a control pressure chamber that acts in the direction of a closing position, which control pressure chamber is pressurizable by the load pressure of the elevating drive system and is in flow communication with a reservoir when the elevating drive system control valve is actuated to a descent position:

a pressure relief valve, wherein the control pressure chamber is in flow communication with the pressure relief valve which is a seat valve and is in flow communication with a reservoir, wherein the relief valve is movable into a closed position by a load pressure of the elevating drive system, and into an open position when the control valve of the elevating drive system is actuated into the descent position in which the control pressure chamber of the check valve is in communication with the reservoir; and a stepper motor connected to the control valve of the elevating drive system, wherein the stepper motor is connected with the relief valve and moves the relief valve into the open position when the elevating drive system control valve is actuated into the descent position;

wherein the control valve of the elevating drive system is a longitudinal slide valve with a valve slide, and the stepper motor is connected to a control piston of the elevating drive system control valve by a transmission, wherein the valve slide is mounted non-rotationally but so that it is movable longitudinally in a housing boring, and wherein a spring device holds the valve slide in a middle position in a non-actuated status, and wherein the relief valve has a valve body which is effectively connected with the valve slide of the control valve of the elevating drive system by an actuator element.

20. A valve system for the hydraulic work system of a work vehicle, comprising:

an elevating drive system for raising and lowering a load, the elevating drive system including a control valve, a hydraulic cylinder and a hydraulic line extending between the control valve and the hydraulic cylinder;

a tilting drive system having a hydraulic cylinder and a control valve, with admission and discharge lines in flow communication with the tilting drive system control valve; and flow regulators having open and closed positions located in the tilting drive system admission and discharge lines, wherein the flow regulators are pressurized toward the closed position by a pressure upstream of a throttle point of the tilting drive system control valve and toward an open position by a pressure downstream of the throttle point of the tilting drive system control valve and a spring, and wherein the flow regulator in the admission line is controlled by a pressure decrease at an admission-side throttle point of the control valve and the flow regulator in the discharge line is controlled by a pressure decrease at a discharge-side throttle point of the control valve.

* * * * *

UNITED STATES PATENT AND TRADEMARK OFFICE

CERTIFICATE OF CORRECTION

PATENT NO. : 6,644,169 B2
DATED : November 11, 2003
INVENTOR(S) : Horst Deininger et al.

It is certified that error appears in the above-identified patent and that said Letters Patent is hereby corrected as shown below:

Column 19,
Line 50, after "descent position" delete colon and insert -- ; --.

Signed and Sealed this

Eleventh Day of May, 2004

JON W. DUDAS
*Acting Director of the United States Patent and Trademark Office*